US010450990B2

(12) United States Patent
Cedfors

(10) Patent No.: US 10,450,990 B2
(45) Date of Patent: Oct. 22, 2019

(54) FUEL SYSTEM FOR INTERNAL COMBUSTION ENGINE AND A METHOD TO LESSEN PRESSURE FLUCTUATIONS IN A FUEL FILTER DEVICE IN A FUEL SYSTEM

(71) Applicant: Scania CV AB, Södertälje (SE)

(72) Inventor: Dan Cedfors, Tullinge (SE)

(73) Assignee: Scania CV AB, Södertälje (SE)

( * ) Notice: Subject to any disclaimer, the term of this patent is extended or adjusted under 35 U.S.C. 154(b) by 224 days.

(21) Appl. No.: 15/319,290

(22) PCT Filed: Jun. 12, 2015

(86) PCT No.: PCT/SE2015/050681
§ 371 (c)(1),
(2) Date: Dec. 15, 2016

(87) PCT Pub. No.: WO2016/007066
PCT Pub. Date: Jan. 14, 2016

(65) Prior Publication Data

US 2017/0130665 A1 May 11, 2017

(30) Foreign Application Priority Data

Jul. 8, 2014 (SE) ..... 1450876

(51) Int. Cl.
*F02D 41/30* (2006.01)
*F02M 37/00* (2006.01)
(Continued)

(52) U.S. Cl.
CPC ..... *F02D 41/3082* (2013.01); *F02D 29/02* (2013.01); *F02D 33/006* (2013.01);
(Continued)

(58) Field of Classification Search
CPC ..... F02M 37/0052; F02M 37/0088; F02M 37/08; F02M 37/20; F02M 37/0047;
(Continued)

(56) References Cited

U.S. PATENT DOCUMENTS 4,478,197 A * 10/1984 Yasuhara ..... F02D 33/006 123/510
4,602,605 A * 7/1986 Adkins ..... F02D 33/003 123/198 D
(Continued)

FOREIGN PATENT DOCUMENTS

CN 103133149 A 6/2013
DE 10059571 A1 6/2001
(Continued)

OTHER PUBLICATIONS

Written Opinion of The International Searching Authority related to PCT/SE2015/050681 dated Oct. 16, 2015.
(Continued)

*Primary Examiner* — Erick R Solis
*Assistant Examiner* — Anthony L Bacon
(74) *Attorney, Agent, or Firm* — Moore and Van Allen PLLC; W. Kevin Ransom

(57) ABSTRACT

A fuel system for an internal combustion engine is provided, which comprises a first fuel tank, a fuel filter device, arranged between a low pressure pump operated by an electric motor and a high pressure pump, a first fuel conduit, through which the low pressure pump is arranged to supply fuel to the fuel filter device, and a control device, arranged in connection with an electric motor operating the low pressure pump. An overflow conduit is arranged in connection with a deaeration outlet, arranged in the fuel filter device and the first fuel tank, and the control device is arranged to control the electric motor, in such a way that the
(Continued)

low pressure pump is active when the internal combustion engine is turned off for a limited period, whereby fuel may flow from the fuel filter device via the deaeration outlet and the overflow conduit, back to the first fuel tank.

20 Claims, 3 Drawing Sheets

(51) Int. Cl.

| | |
|---|---|
| ***F02M 37/08*** | (2006.01) |
| ***F02M 37/20*** | (2006.01) |
| ***F02D 41/04*** | (2006.01) |
| ***F02D 41/38*** | (2006.01) |
| ***F02D 29/02*** | (2006.01) |
| ***F02D 33/00*** | (2006.01) |
| *F02N 11/08* | (2006.01) |

(52) U.S. Cl.
CPC ..... *F02D 41/042* (2013.01); *F02M 37/0047* (2013.01); *F02M 37/0052* (2013.01); *F02M 37/0088* (2013.01); *F02M 37/08* (2013.01); *F02M 37/20* (2013.01); *F02D 41/3836* (2013.01); *F02D 2200/0602* (2013.01); *F02N 11/0814* (2013.01)

(58) Field of Classification Search
CPC .. F02D 33/006; F02D 41/042; F02D 41/3082; F02D 41/3836
See application file for complete search history.

(56) References Cited

U.S. PATENT DOCUMENTS

| | | | | |
|---|---|---|---|---|
| 5,085,198 | A * | 2/1992 | Bartlett | F02D 33/006 123/381 |
| 6,382,184 | B2 | 5/2002 | Nakamura et al. | |
| 6,408,825 | B1 | 6/2002 | Enoki et al. | |
| 6,508,225 | B1 * | 1/2003 | Hiki | F02B 23/104 123/198 D |
| 2001/0023683 | A1 | 9/2001 | Nakamura et al. | |
| 2008/0283026 | A1 * | 11/2008 | Wolber | F02D 33/006 123/447 |
| 2009/0271096 | A1 | 10/2009 | Matsubara | |
| 2013/0144507 | A1 | 6/2013 | Lee | |

FOREIGN PATENT DOCUMENTS

| | | | |
|---|---|---|---|
| DE | 102010028010 | A1 | 10/2011 |
| EP | 116419 | A2 | 8/1984 |
| JP | 2000213431 | A | 8/2000 |
| SE | 537126 | C2 | 2/2015 |
| WO | 2014193292 | A1 | 12/2014 |

OTHER PUBLICATIONS

International Search Report of The International Searching Authority for PCT/SE2015/050681 dated Oct. 16, 2015.
International Preliminary Report on Patentability for International Application No. PCT/SE2015/050681 dated Jan. 10, 2017.
European Search Report for International Application No. PCT/SE2015/050681 dated May 22, 2018.
Supplementary European Search Report for European Patent Application No. EP15818501 dated May 11, 2018.
Swedish Office Action for Swedish Patent Application No. SE1450876-6 dated Feb. 23, 2015.
Korean Office Action for Korean Patent Application No. 10-2017-7001020 dated Oct. 20, 2017.
Scania CV AB, Chinese Application No. 201580035175.9, First Office Action, dated Mar. 5, 2019.

* cited by examiner

FUEL SYSTEM FOR INTERNAL COMBUSTION ENGINE AND A METHOD TO LESSEN PRESSURE FLUCTUATIONS IN A FUEL FILTER DEVICE IN A FUEL SYSTEM

CROSS-REFERENCE TO RELATED APPLICATION(S)

This application is a national stage application (filed under 35 § U.S.C. 371) of PCT/SE15/050681, filed Jun. 12, 2015 of the same title, which, in turn claims priority to Swedish Application No. 1450876-6, filed Jul. 8, 2014 of the same title; the contents of each of which are hereby incorporated by reference.

FIELD OF THE INVENTION

The present invention relates to a fuel system for an internal combustion engine, an internal combustion engine with such a fuel system, a vehicle with such a fuel system and a method to lessen pressure fluctuations in a fuel filter device in a fuel system.

BACKGROUND OF THE INVENTION

Combustion engines, such as diesel engines or Otto engines, are used in several types of applications and vehicles today, for example in heavy goods vehicles, such as trucks or buses, passenger cars, motor boats, vessels, ferries and ships. Combustion engines are also used in industrial engines and/or engine driven industrial robots, power plants such as e.g. electric power plants comprising a diesel generator, and in locomotives.

Combustion engines may be driven by diesel, petrol, or ethanol, or other types of biofuels. Such engines are is equipped with a fuel system to transport fuel from one or several fuel tanks to the internal combustion engine's injection system. The fuel system comprises one or several fuel pumps, which may be driven mechanically by the internal combustion engine, or be driven by an electric motor. The fuel pumps create a fuel flow and pressure to transport the fuel to the internal combustion engine's injection system, which supplies the fuel to the internal combustion engine's combustion chamber.

Fuel systems also comprise fuel filters for filtration of the fuel before it reaches the internal combustion engine's injection system. The internal combustion engine and its injection system are sensitive to impurities and may be negatively impacted if the fuel is too polluted. Impurities may mean solid particles, gas or liquid.

Some combustion engines or hybrid engines may be turned off when the vehicle stops, for example at a red light or in a traffic jam, with the objective of reducing fuel consumption and emissions. This function entails that the internal combustion engine is frequently started and stopped. When the internal combustion engine is turned off, the pressure in the fuel system drops drastically, since fuel no longer needs to be supplied to the internal combustion engine. On the other hand each start of the internal combustion engine requires a rapid pressure build-up in the fuel system, in order to quickly achieve sufficient supply of fuel to the internal combustion engine. Accordingly, frequent starts/stops of the internal combustion engine result in frequent pressure fluctuations in the fuel system, and therefore also in the fuel filter. During start of the internal combustion engine, and the resulting pressure increase in the fuel system, fuel is thus supplied via the fuel filter at a high pressure. The high pressure results in a risk that impurities in the fuel may be pressed through the filter, which may impact the functionality of the injection system and the internal combustion engine. Even if only a small amount of impurities reaches the internal combustion engine, the consequence may be that the internal combustion engine may not be driven by the fuel. Furthermore, there is a risk that the fuel filter may be damaged or collapse due to the pressure fluctuations and the high pressure that often has to be achieved in the system. The risk that the impurities may reach the internal combustion engine increases with the frequency of the fuel filter being subjected to a high pressure, as does the risk of damage to the fuel filter. It is thus desirable to lessen pressure fluctuations in the fuel filter.

Despite prior art solutions in this area, there remains a need to further develop a fuel system, which contributes to lessening pressure fluctuations in a fuel filter in a fuel system for an internal combustion engine, and which thus minimizes the risk of damage to the fuel filter and the internal combustion engine.

SUMMARY OF THE INVENTION

The objective of the invention is to achieve a fuel system for an internal combustion engine, which fuel system lessens pressure fluctuations in a fuel filter in the fuel system.

It is also an objective of the invention to achieve a fuel system for an internal combustion engine, which fuel system minimizes the risk of operational disruptions in the internal combustion engine.

Another objective of the invention is to achieve a fuel system for an internal combustion engine, which fuel system minimizes the risk of operational disruptions in a fuel filter in the fuel system.

It is also an objective of the invention to achieve a fuel system for an internal combustion engine, which fuel system is compact and space-saving.

Another objective of the invention is to achieve a method to lessen pressure fluctuations in a fuel filter in the fuel system of an internal combustion engine.

According to the invention, these objectives are achieved with a fuel system for an internal combustion engine, which fuel system comprises a first fuel tank, a fuel filter device arranged between a low pressure pump operated by an electric motor and a high pressure pump, a first fuel conduit through which the low pressure pump is arranged to supply fuel to the fuel filter device, and a control device arranged in connection with an electric motor operating the low pressure pump. Furthermore, an overflow conduit is arranged in connection with a deaerating outlet arranged in the fuel filter device and the first fuel tank, and the control device is arranged to control the electric motor, so that the low pressure pump is active when the internal combustion engine is turned off for a limited period. Fuel may then flow from the fuel filter device, via the deaerating outlet and the overflow conduit, back to the first fuel tank.

The invention also relates to an internal combustion engine and a vehicle comprising the system described above.

According to another aspect, the invention relates to a method to lessen pressure fluctuations in a fuel filter device in a fuel system for an internal combustion engine, which fuel system comprises a first fuel tank, a fuel filter device arranged between a low pressure pump operated by an electric motor and a high pressure pump, a first fuel conduit, via which the low pressure pump is arranged to supply fuel to the fuel filter device, and a control device arranged in connection with an electric motor operating the low pressure pump. The method comprises the steps:

a) identifying shutdown of the internal combustion engine;

b) ensuring that the low pressure pump is active, using the control device; and c) ensuring that fuel flows from the fuel filter device back to the first fuel tank, via a deaeration outlet arranged in the fuel filter device and an overflow conduit, arranged in connection with the deaeration outlet and the first fuel tank.

Additional features and advantages of the invention are described below in the detailed description of the invention.

BRIEF DESCRIPTION OF THE DRAWINGS

Below is a description, as an example, of embodiments of the invention with reference to the enclosed drawings, in which.

DETAILED DESCRIPTION OF THE INVENTION

Figure 1:
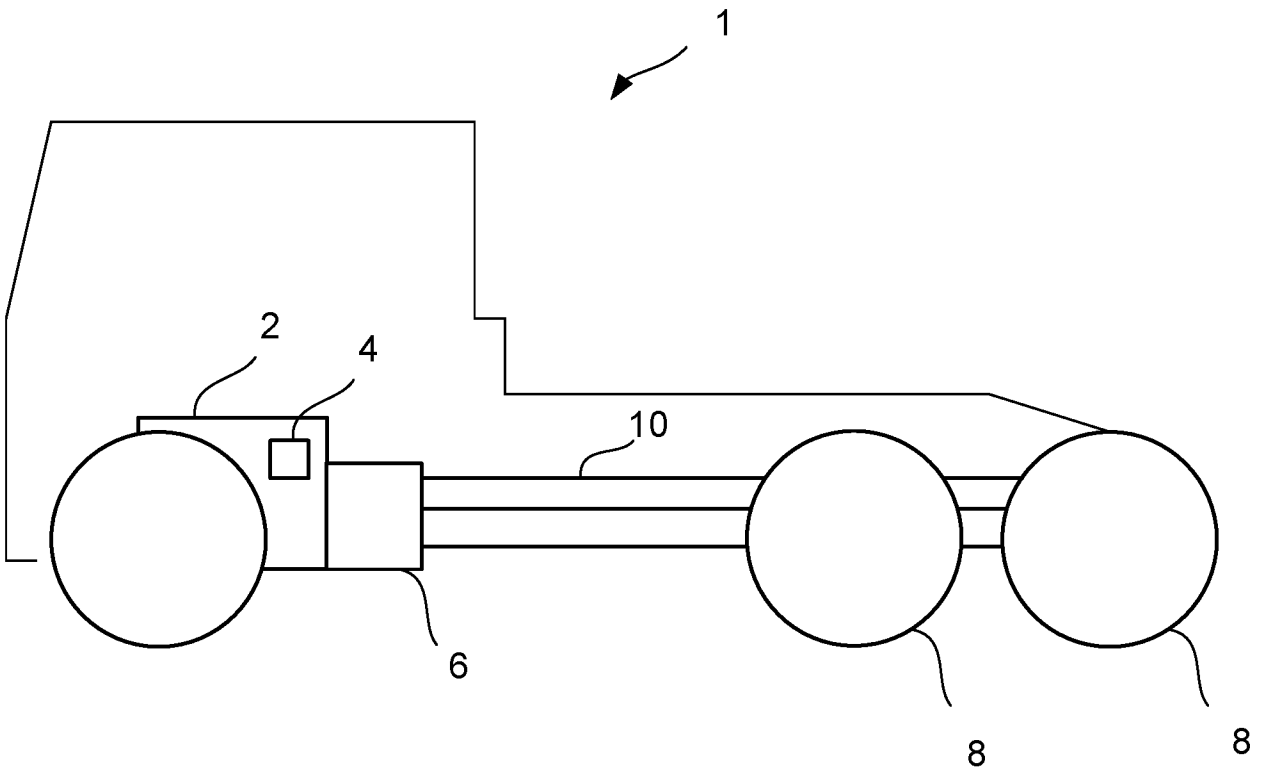
FIG. 1 shows a schematic side view of a vehicle, which comprises a fuel system for an internal combustion engine according to the present invention.

The invention is described below with reference to the fuel system and the method, which were described generally above.

When an internal combustion engine is turned off, no fuel needs to be supplied to the internal combustion engine and accordingly the low pressure pump and the high pressure pump are usually deactivated, and the pressure in the fuel system drops. When the internal combustion engine is started again, a rapid pressure build-up in the fuel system is required, in order to enable sufficient supply of fuel to the internal combustion engine. The low pressure pump must then be controlled towards a high rotational speed, in order to be able to supply fuel through the fuel filter device with a sufficiently high pressure. Every time the internal combustion engine is started, such a pressure fluctuation arises, also referred to as a pressure shock or a pulsation. Such a high pressure may result in impurities being pressed through the fuel filter device and further along to the internal combustion engine, which may cause a stoppage of the internal combustion engine. Furthermore, the high pressure with which the fuel is supplied through the fuel filter device may damage the fuel filter device. If the internal combustion engine is turned off and started frequently, the fuel filter device is more often subjected to high pressure, and these frequent pressure fluctuations in the fuel filter device thus increase the risk of damage to the fuel filter device, and the risk that impurities may cause operational disruptions.

By arranging a low pressure pump operated by an electric motor in a fuel system, a broader control interval is allowed than with a mechanical pump, which is usually operated and controlled by an internal combustion engine and in particular by the engine speed of the internal combustion engine. The low pressure pump operated by an electric motor may be controlled towards other parameters than rotational speed, e.g. fuel filter clogging level and pressure inside the fuel conduits. By arranging a control device to control the electric motor, so that the low pressure pump is active when the internal combustion engine is turned off, fuel will continue to be supplied through the first fuel conduit to the fuel filter device, and therefore a certain pressure in the fuel filter device will be retained even when the internal combustion engine is turned off. In this manner, the pressure fluctuation arising in the fuel filter device when the internal combustion engine is subsequently started again is lessened. Therefore, the risk that impurities may be pressed through the fuel filter device and cause operational disruptions is minimized. Furthermore, the risk that the fuel filter device may be damaged or collapse because of large and frequent pressure fluctuations is minimized.

The low pressure pump's electric motor is suitably arranged in connection with the control device via a CAN-bus. Signals may be received and sent via a connection consisting of one or several cables, which may be a CAN-bus (Controller Area Network), MOST-bus (Media Oriented Systems Transport), or some other type of bus configuration, or a wireless connection. The control device may be a separate control device for the electric motor of the low pressure pump, or alternatively the control device may consist of logic in a control device for the internal combustion engine. The vehicle's other control devices may in their turn also be connected to the CAN-bus. Preferably the control device identifies that the internal combustion engine has been turned off, following which it controls the low pressure pump, so that it is active. The fact that the internal combustion engine has been turned off may be identified by the control device, for example by way of the requested fuel from the high pressure pump and/or the injection system being equal to zero.

According to one aspect of the present invention, the control device is arranged to reduce the rotational speed of the low pressure pump when the internal combustion engine is turned off. Preferably, the low pressure pump has a low rotational speed when the internal combustion engine is turned off for a limited period of time, in order to generate a pressure in the fuel filter. When the internal combustion engine is turned off, the rotational speed of the low pressure pump corresponds to a low current and power consumption in the electric motor. By reducing the engine speed of the low pressure pump when the internal combustion engine is turned off, most of the fuel passes through the deaeration outlet, instead of flowing further to the high pressure pump. The filter house is pressurized with a low pressure, for example a maximum of around one bar, working like an accumulator. Pressurization and recirculation of a certain byflow entails a faster ramp-up of the fuel, and less amplitude in the pressure spike when the engine is restarted. The deaeration outlet ensures that the pressure inside the filter house is kept at an optimal level and does not become too high.

Suitably, the low pressure pump is active for a limited period during which the internal combustion engine is turned off. The control device is thus preferably arranged to deactivate the low pressure pump when the internal combustion engine has been turned off for a predetermined period. The predetermined period may e.g. be between 1 and 10 minutes, preferably between 5 and 8 minutes. The low pressure pump may be deactivated by controlling the control device, so that it turns off the electric motor after a predetermined period of time. This ensures that the low pressure pump is only active when the internal combustion engine turned off for brief periods, for example when stopping at traffic lights or in traffic jams.

The fuel filter device preferably comprises a filter house, in which a filter element is arranged. The deaeration outlet is suitably arranged in the filter house. When the internal combustion engine is in operation, the fuel is supplied to the filter house via the first fuel conduit with a certain pressure from the low pressure pump, following which the fuel passes through the filter element and impurities are filtered out. Subsequently, the fuel is supplied further along to the high pressure pump and the internal combustion engine's injection system. A substantially negligible part of the fuel will also pass through the deaeration outlet for deaeration. By controlling the low pressure pump, so that it is active when the internal combustion engine is turned off, fuel will continue to be supplied to the filter house, but most of the fuel will instead flow through the deaeration outlet to the overflow conduit and back to the first fuel tank. In this manner, a certain pressure is retained in the fuel filter device, and the pressure fluctuations, which normally arise when the internal combustion engine is started and stopped, are lessened. The stress on the filter element is thus minimized.

According to one aspect of the present invention, the deaeration outlet is arranged in the fuel filter device, so that the fuel does not pass through the filter element before passing through the deaeration outlet. In this way, the stress on the filter element is minimized and the clogging of the filter element is limited. Alternatively, the deaeration outlet is arranged so that the fuel passes through the filter element, before passing through the deaeration outlet. In this manner, the fuel is filtered and returned back to the first fuel tank through the overflow conduit, and accordingly the filtering of the fuel is repeated.

Preferably, a valve device is arranged at the deaeration outlet in the fuel filter device. The valve device suitably consists of a throttle valve, whereby a flow limitation and a pressure drop are achieved over the throttle. Since the flow through the deaeration outlet is limited, the pressure inside the filter house will increase, and the filter house will therefore act as a pressurized accumulator. When the internal combustion engine is started again, the pressurized fuel will already be in the filter house, and therefore fuel may quickly reach the internal combustion engine, and a rapid and efficient start of the internal combustion engine is achieved. Furthermore, the throttle valve and the pressure in the filter house entail that the pressure difference arising at the start of the internal combustion engine is minimized, which minimized the risk of damage to the fuel filter device and of impurities being pressed through the filter element due to a drastic pressure increase.

According to one aspect of the present invention, the fuel system comprises a second fuel tank. Suitably, the first fuel tank is adapted so that it holds a smaller volume than the second fuel tank. This design allows a less bulky first fuel tank, which is easier to arrange inside a chassis with limited space. Thus, a non-bulky fuel system is achieved.

Preferably, a transfer pump is arranged to supply the first fuel tank with fuel. The transfer pump suitably supplies fuel from the second fuel tank, via a second fuel conduit, further to the first fuel tank. Preferably a pre-filter is arranged downstream of the transfer pump and upstream of the main low pressure pump. The fuel reaching the low pressure pump operated by the electric motor is thus pre-filtered, which entails that the low pressure pump is protected against impurities in an advantageous manner, which reduces the risk of operational disruptions in the low pressure pump. The transfer pump is preferably operated by an electric motor. In this manner a more efficient and flexible regulation of fuel supply to the first fuel tank is achieved.

Suitably the low pressure pump is arranged in the first fuel tank. In this manner, the low pressure pump is protected from the environment, and a natural cooling of the fuel in the first fuel tank is obtained. Alternatively, the transfer pump and the pre-filter are also arranged inside the first fuel tank.

Suitably, a fuel return conduit is arranged in connection with the first fuel tank and the fuel system's high pressure system. Pressurized warm fuel may in this manner be returned back to the first fuel tank, instead of being transported to the internal combustion engine's combustion chamber. The warm fuel may thus heat cold fuel in the fuel tank, and in this manner reduce the risk of paraffination during operation.

Other advantages of the invention are set out in the detailed description of the invention's example embodiments below.

FIG. 1 shows a schematic side view of a vehicle 1, which vehicle comprises a fuel system 4 for an internal combustion engine 2 according to the present invention. The internal combustion engine 2 is connected to a gearbox 6, which is further connected to the driving wheels 8 of the vehicle 1 via a transmission. The vehicle also comprises a chassis 10.

Figure 2:
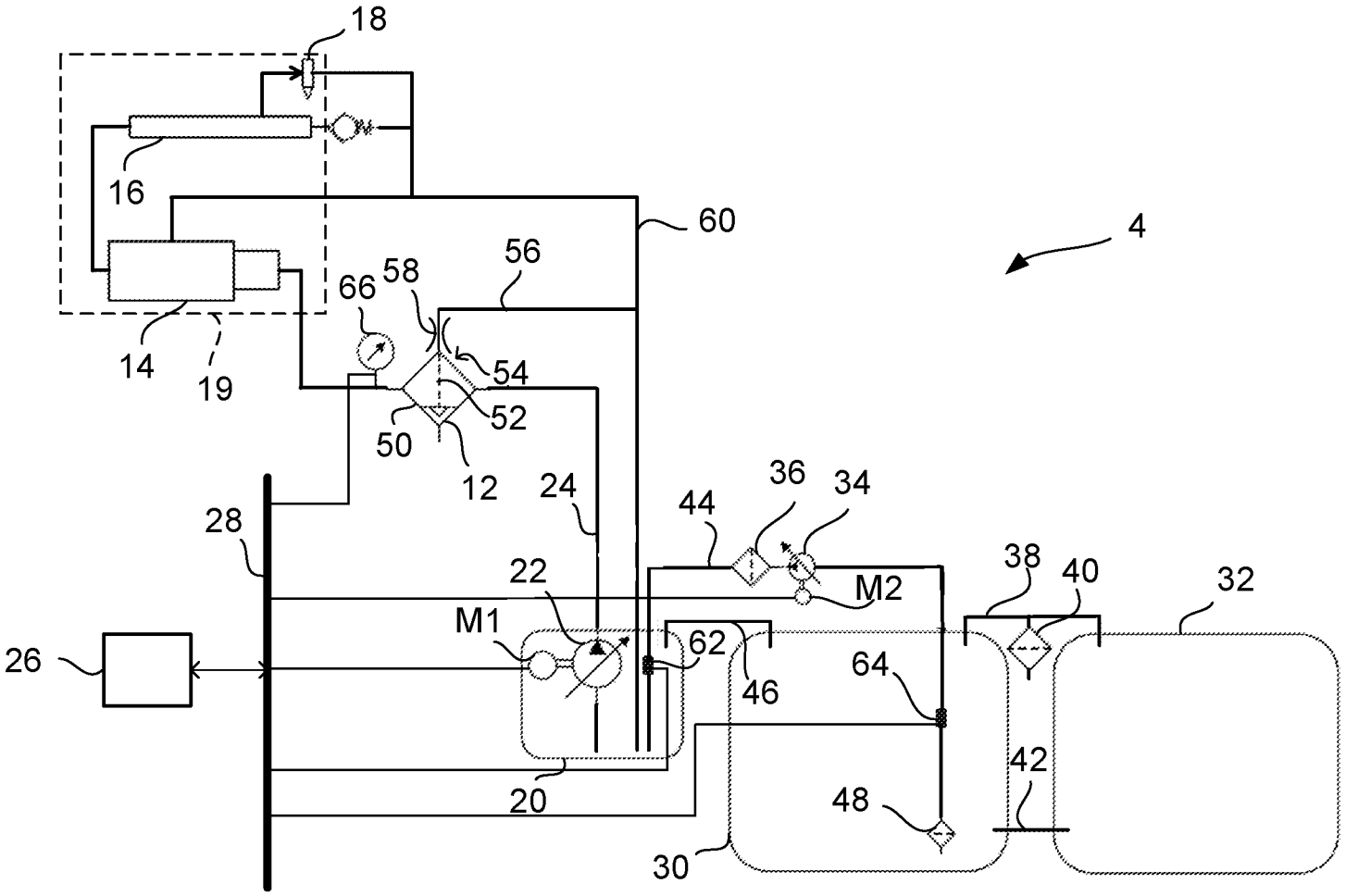
FIG. 2 shows a coupling diagram for a fuel system according to the present invention.

FIG. 2 shows a coupling diagram for a fuel system 4 in an internal combustion engine 2 according to the present invention. The fuel system 4 comprises several components, among which a fuel filter device 12, a high pressure pump 14, an accumulator in the form of a so-called common rail 16, and an injection system 18 schematically displayed in the form of a fuel injector, are arranged in the internal combustion engine 2 (the internal combustion engine 2 is displayed in FIG. 1). Alternatively, the common rail 16 may be replaced by another form of injection system 18, e.g. a piezo- or a unit injection system. The high pressure pump 14, the common rail 16 and the injection system 18 constitute components in the high pressure system 19 of the fuel system 4. The fuel system 4 also comprises a first fuel tank 20, a low pressure pump 22, a first fuel conduit 24, through which the low pressure pump 22 is arranged to supply fuel to the fuel filter device 12, and a control device 26, arranged in connection with an electric motor M1, operating the low pressure pump 22. The control device 26 is arranged in connection with the electric motor M1 via a CAN-bus 28. When the internal combustion engine 2 is in operation, the low pressure pump 22 pumps fuel from the fuel tank 20 through the fuel filter device 12, arranged downstream, and further along to the high pressure pump 14, which then pumps the fuel further to the internal combustion engine 2. The control device 26 is arranged to control the low pressure pump 22, so that it is active when the internal combustion engine 2 is turned off for a limited period. In this manner, a certain pressure is retained in the fuel filter device 12 even when the internal combustion engine 2 is turned off, so that pressure fluctuations in the fuel filter device 12 are lessened.

The fuel system 4 may also comprise a second fuel tank 30, a third fuel tank 32, a transfer pump 34 and a pre-filter 36. The second and the third fuel tanks 30, 32 are, in their respective top parts, connected with a ventilation conduit 38, communicating with the surrounding environment via an air filter 40. The ventilation conduit 38 ensures that the pressure in the respective tanks 30, 32 is and remains substantially the same, and equal to the ambient air pressure, regardless of how much fuel is in the respective tanks. The air filter 40 prevents impurities in the surrounding air from penetrating into the ventilation conduit 38 in connection with ventilation of the tanks. The first fuel tank 20 is adapted to hold a smaller volume than the second fuel tank 30 and the third fuel tank 32. The second fuel tank 30 and the third fuel tank 32 correspond to main fuel tanks and hold substantially the same volume and have a self-regulating flow between each other, via a connection conduit 42, arranged between the lower part of the second fuel tank 30 and the third fuel tank 32.

The transfer pump 34 is, according to FIG. 2, arranged between the first fuel tank 20 and the second fuel tank 30. The low pressure pump 22 may be arranged inside the first fuel tank 20, and is thus protected from the environment and cooled by the fuel. The transfer pump 34 is operated by a second electrical motor M2, and its main task is to supply fuel from the second fuel tank 30 to the first fuel tank 20, via a second fuel conduit 44. The second electric motor M2 is arranged in connection with the control device 26 via the CAN-bus 28. The second electric motor M2, and consequently the transfer pump 34, thus are controlled by the control device 26.

Between the first fuel tank 20 and the second fuel tank 30 an overflow conduit 46 is arranged, so that fuel may be transported from the first fuel tank 20 to the second fuel tank 30, if the first fuel tank 20 becomes overfilled.

The pre-filter 36 is arranged downstream of the transfer pump 34 and is preferably a fine mesh, water separating filter. In the second fuel tank 30, upstream of the transfer pump 34, a coarse mesh sieve 48 is arranged, through which the transfer pump 28 sucks fuel. The coarse mesh sieve 48 filters away particles above a certain predetermined size. The transfer pump 34 then pressurizes the fuel and feeds it through the pre-filter 36 further along to the first fuel tank 20, via the second fuel conduit 44. The fuel in the first fuel tank 20 has thus passed both a coarse mesh sieve 48 and fine mesh pre-filter 36, which entails that the low pressure pump 22, which is arranged in the first fuel tank 20, is protected against impurities.

The fuel filter device 12 comprises a filter house 50, in which a filter element 52 is arranged, through which fuel from the first fuel tank 20 is filtered. The filter house 50 has a deaeration outlet 54, with which an overflow conduit 56 is connected. The overflow conduit 56 is also connected with the first fuel tank 20. In this manner, fuel may flow from the filter house 50, through the deaeration outlet 54, further along through the overflow conduit 56 and back to the first fuel tank 20, when the internal combustion engine 2 is turned off and the low pressure pump 22 is active. When the internal combustion engine 2 is in operation, the filter house 50 is deaerated via the deaeration outlet 54.

A valve device 58 in the form of a throttle valve is arranged at the deaeration outlet 54, and thus in connection with the overflow conduit 56. The throttle valve entails that most of the fuel supplied by the low pressure pump 22 to the fuel filter device 12 when the internal combustion engine 2 is turned off, flows through the deaeration outlet 54, the throttle valve 58 and the overflow conduit 56, back to the first fuel tank 20. The throttle valve 58 also entails a flow restriction and a pressure drop over the throttle, which in turn has the consequence that the pressure builds up in the filter house 50. The filter house 50 thus acts like a pressurized accumulator, which means that there is always pressurized fuel in the filter house 50, as long as the low pressure pump 22 is active, even if the internal combustion engine 2 is turned off. In this manner, a quick and efficient start of the internal combustion engine 2 may be achieved.

Further, the fuel system 4 comprises a fuel return conduit 60, through which pressurized warm fuel is returned from the high pressure system 19 of the fuel system 4, back to the first fuel tank 20.

A first level sensor 62 is arranged in the first fuel tank 20, in order to identify the fuel level in the first fuel tank 20. When the fuel level in the first fuel tank 20, determined with the level sensor 62, falls below a predetermined level threshold, the transfer pump 34 is controlled to feed fuel from the second fuel tank 30 to the first fuel tank 20. A second level sensor 64 is arranged in the second fuel tank 30, in order to identify the fuel level in the second fuel tank 30. The first level sensor 62 and the second level sensor 64 are connected to the CAN bus 28 and the control device 26, which controls the transfer pump 34 and the low pressure pump 22.

A pressure sensor 66 is arranged downstream of the fuel filter device 12. The pressure sensor is connected to the control device 26 via the CAN-bus 28. The pressure sensor may control the first electric motor M1, which operates the low pressure pump 22, by allowing a setpoint value regardless of the conditions in the system, e.g. in case of a pressure drop in the system, regardless of the fuel filter clogging level or regardless of the optimal fuel requirements from the internal combustion engine 2, the injection system 18 or the control system.

Figure 3:
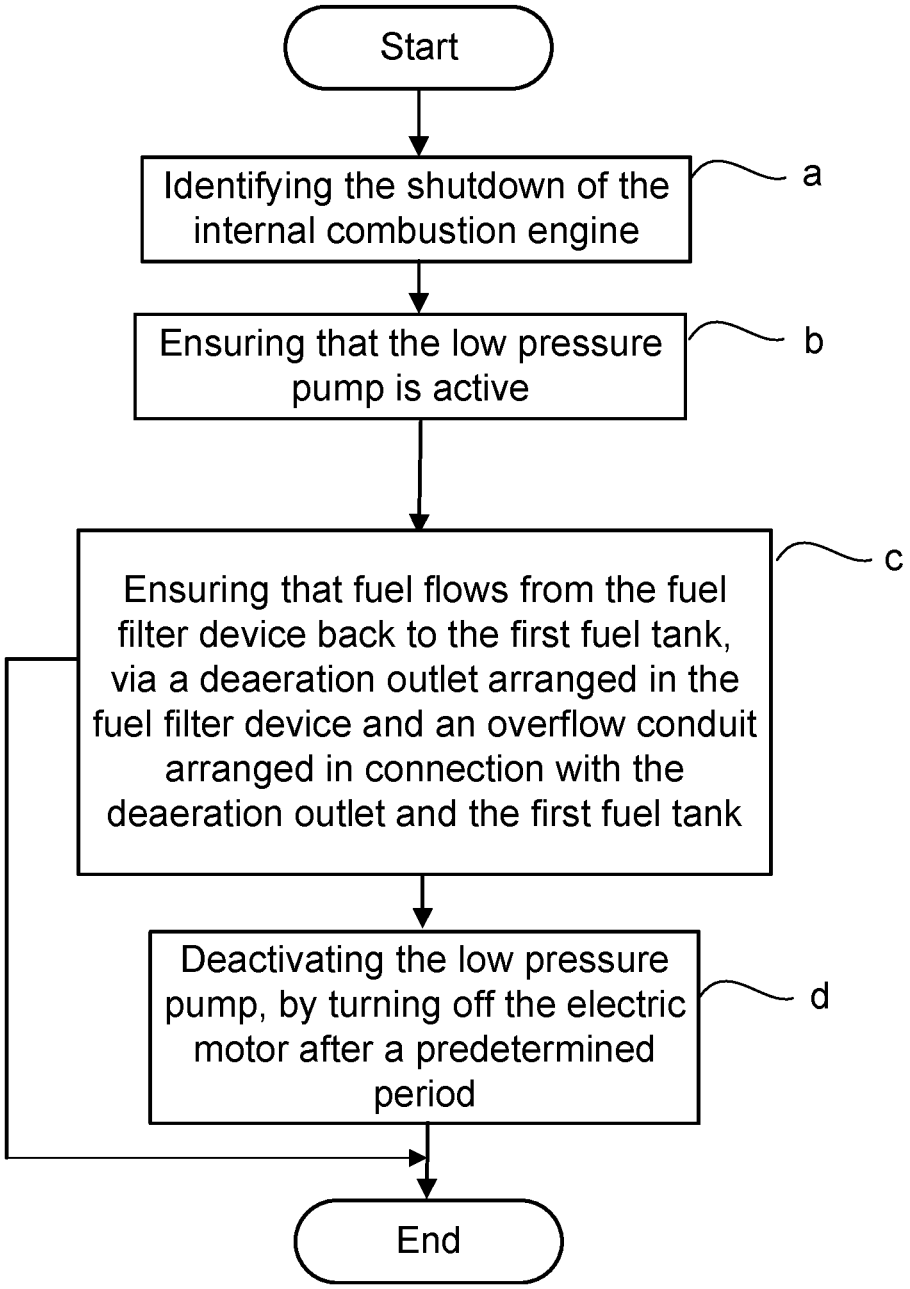
FIG. 3 shows a flow chart of a method to lessen pressure fluctuations in a fuel filter device in a fuel system according to the present invention.

FIG. 3 shows a flow chart of a method to lessen pressure fluctuations in a fuel filter device 12 in a fuel system 4 according to the present invention. The fuel system 4 may be adapted as described in FIG. 2. The method according to the invention comprises the step a) identifying the shutdown of the internal combustion engine 2, the step b) ensuring that the low pressure pump 22 is active, with the use of control device 26, and the step c) ensuring that fuel flows from the fuel filter device 12 back to the first fuel tank 20, via a deaeration outlet 54 arranged in the fuel filter device 12, and an overflow conduit 56 arranged in connection with the deaeration outlet 54 and the first fuel tank 20. By keeping the low pressure pump 22 active when the internal combustion engine 2 is turned off, a certain pressure is retained in the fuel filter device 12. Thus, the pressure difference is reduced between a state when the internal combustion engine 2 is turned off and a state when the internal combustion engine 2 is started. Thus, pressure fluctuations in the fuel filter device 12 are lessened.

Suitably, the control device 26 identifies that the internal combustion engine 2 has been turned off, and instead of, as in prior art, deactivating the low pressure pump 22, the control device 26 controls the low pressure pump's 22 electric motor M1 in such a manner that the electric motor 22 is active. The control device 26 suitably identifies that the internal combustion engine 2 has been turned off. Suitably, the control device 26 ensures that the low pressure pump's 22 rotational speed is reduced, preferably to a rotational speed with a low power and current consumption. The control device 26 may control the electric motor M1, so that the low pressure pump 22 obtains a low engine speed.

A valve device 58 is provided at the deaeration outlet 54 in the fuel filter device 12. The valve device 58 suitably consists of a throttle valve, whereby a flow limitation and a pressure drop are achieved at the deaeration outlet 54. Providing the throttle value 58, and reducing the rotational speed of the low pressure pump 22, and thus reducing the pressure in the first fuel conduit 24 and the fuel filter device 12, ensures that most of the fuel supplied by the low pressure pump 22 to the fuel filter device 12 passes through the deaeration outlet 54, and flows back to the first fuel tank 20. Furthermore, the throttle valve 58 entails that the pressure inside the filter house 50 builds up and that the filter house 50 thus acts as a pressurized accumulator. If the internal combustion engine 2 is started again after a period, pressurized fuel is already in the fuel filter device 12, and a quick and efficient start of the internal combustion engine 2 may be achieved.

The method suitably also comprises step d) deactivating the low pressure pump 22, by turning off the electric motor M1 after a predetermined period. Suitably the low pressure pump 22 is kept active for a predetermined period, during which the internal combustion engine 2 is turned off. The control device 26 preferably deactivates the low pressure pump 22 when the internal combustion engine 2 has been turned off for a predetermined period. The predetermined period may e.g. be between 3 and 10 minutes, preferably between 5 and 8 minutes. This ensures that the low pressure pump 22 is only active when the internal combustion engine 2 is turned off for brief periods, for example when stopping at traffic lights or in traffic jams.

The components and features specified above may, within the framework of the invention, be combined between different embodiments specified.

The invention claimed is:

1. A fuel system for an internal combustion engine, which fuel system comprises:

a first fuel tank;

a fuel filter device, arranged between a low pressure pump operated by an electric motor and a high pressure pump;

a first fuel conduit, through which the low pressure pump is arranged to supply fuel to the fuel filter device;

a deaeration outlet associated with the fuel filter device;

an overflow conduit arranged in connection with the deaeration outlet and the first fuel tank; and a control device arranged in connection with the electric motor, operating the low pressure pump, wherein the control device is arranged to control the electric motor, in such a way that the low pressure pump is active for a limited period after the internal combustion engine is turned off, and wherein the control device is arranged to reduce the rotational speed of the low pressure pump when the internal combustion engine is turned off, thereby ensuring that fuel flows from the fuel filter device back to the first fuel tank, via the deaeration outlet arranged in the fuel filter device, and the overflow conduit arranged in connection with the deaeration outlet and the first fuel tank.

2. A fuel system according to claim 1, wherein the control device is arranged to deactivate the low pressure pump when the internal combustion engine has been turned off for a predetermined period.

3. A fuel system according to claim 1, wherein the fuel filter device comprises a filter house, wherein a filter element is arranged.

4. A fuel system according to claim 1 further comprising a ventilation device arranged at the deaeration outlet of the fuel filter device.

5. A fuel system according to claim 4, wherein the ventilation device consists of a throttle valve.

6. A fuel system according to claim 1, wherein the deaeration outlet is arranged in the fuel filter device in such a way that the fuel bypasses the filter element before passing through the deaeration outlet.

7. A fuel system according to claim 1, wherein the deaeration outlet is arranged in the fuel filter device in such a way that fuel passes through the filter element before passing through the deaeration outlet.

8. A combustion engine comprising a fuel system, wherein said fuel system comprises:

a first fuel tank;

a fuel filter device, arranged between a low pressure pump operated by an electric motor and a high pressure pump;

a first fuel conduit, through which the low pressure pump is arranged to supply fuel to the fuel filter device;

a deaeration outlet associated with the fuel filter device;

an overflow conduit arranged in connection with the deaeration outlet and the first fuel tank; and a control device arranged in connection with an electric motor, operating a low pressure pump;

wherein the control device is arranged to control the electric motor, in such a way that the low pressure pump is active for a limited period after the internal combustion engine is turned off, and wherein the control device is arranged to reduce the rotational speed of the low pressure pump when the internal combustion engine is turned off, thereby ensuring that fuel flows from the fuel filter device back to the first fuel tank, via the deaeration outlet arranged in the fuel filter device, and the overflow conduit arranged in connection with the deaeration outlet and the first fuel tank.

9. A combustion engine according to claim 8, wherein the control device of the fuel system is arranged to deactivate the low pressure pump when the internal combustion engine has been turned off for a predetermined period.

10. A combustion engine according to claim 8, wherein the fuel system comprises a ventilation device arranged at the deaeration outlet of the fuel filter device.

11. A combustion engine according to claim 8, wherein the deaeration outlet is arranged in the fuel filter device of the fuel system in such a way that the fuel bypasses the filter element before passing through the deaeration outlet.

12. A combustion engine according to claim 8, wherein the deaeration outlet is arranged in the fuel filter device of the fuel system in such a way that fuel passes through the filter element before passing through the deaeration outlet.

13. A vehicle, comprising a fuel system for an internal combustion engine, wherein the fuel system comprises:

a first fuel tank;

a fuel filter device, arranged between a low pressure pump operated by an electric motor and a high pressure pump;

a first fuel conduit, through which the low pressure pump is arranged to supply fuel to the fuel filter device;

a deaeration outlet associated with the fuel filter device;

an overflow conduit arranged in connection with the deaeration outlet and the first fuel tank; and a control device arranged in connection with an electric motor, operating a low pressure pump;

wherein the control device is arranged to control the electric motor, in such a way that the low pressure pump is active for a limited period after the internal combustion engine is turned off, and wherein the control device is arranged to reduce the rotational speed of the low pressure pump when the internal combustion engine is turned off, thereby ensuring that fuel flows from the fuel filter device back to the first fuel tank, via the deaeration outlet arranged in the fuel filter device, and the overflow conduit arranged in connection with the deaeration outlet and the first fuel tank.

14. A vehicle according to claim 13, wherein the control device of the fuel system is arranged to deactivate the low pressure pump when the internal combustion engine has been turned off for a predetermined period.

15. A vehicle according to claim 13, wherein the fuel system comprises a ventilation device arranged at the deaeration outlet of the fuel filter device.

16. A vehicle according to claim 13, wherein the deaeration outlet is arranged in the fuel filter device of the fuel system in such a way that the fuel bypasses the filter element before passing through the deaeration outlet.

17. A vehicle according to claim 13, wherein the deaeration outlet is arranged in the fuel filter device of the fuel system in such a way that fuel passes through the filter element before passing through the deaeration outlet.

18. A method to lessen pressure fluctuations in a fuel filter device in a fuel system for an internal combustion engine, which fuel system comprises a first fuel tank, a fuel filter device, arranged between a low pressure pump operated by an electric motor and a high pressure pump, a first fuel conduit, via which the low pressure pump is arranged to supply fuel to the fuel filter device, a deaeration outlet associated with the fuel filter device, an overflow conduit arranged in connection with the deaeration outlet and the first fuel tank, and a control device, arranged in connection with an electric motor operating the low pressure pump, wherein the method comprises the steps:

a) identifying shutdown of the internal combustion engine;

b) ensuring that the low pressure pump is active for a limited period after the internal combustion engine is turned off, with the use of the control device, wherein said ensuring comprises reducing the rotational speed of the low pressure pump when the internal combustion engine is turned off; and c) ensuring that fuel flows from the fuel filter device back to the first fuel tank, via the deaeration outlet arranged in the fuel filter device, and the overflow conduit arranged in connection with the deaeration outlet and the first fuel tank.

19. A method according to claim 18, wherein step c) comprises providing a ventilation device at the deaeration outlet of the fuel filter device.

20. A method according to claim 18, the method further comprising the step to:

d) deactivate the low pressure pump by turning off the electric motor after a predetermined period of time.

* * * * *